US008840192B2

(12) United States Patent
Lotscher et al.

(10) Patent No.: US 8,840,192 B2
(45) Date of Patent: Sep. 23, 2014

(54) METHOD FOR PRODUCING A TOOTHBRUSH AND TOOTHBRUSH

(75) Inventors: Jost Lotscher, Buron (CH); Oskar Trevisan, Reussbuhl (CH)

(73) Assignee: Trisa Holding AG, Triengen (CH)

( * ) Notice: Subject to any disclaimer, the term of this patent is extended or adjusted under 35 U.S.C. 154(b) by 116 days.

(21) Appl. No.: 13/520,438

(22) PCT Filed: Dec. 20, 2010

(86) PCT No.: PCT/EP2010/007797

§ 371 (c)(1),
(2), (4) Date: Jul. 25, 2012

(87) PCT Pub. No.: WO2011/091835

PCT Pub. Date: Aug. 4, 2011

(65) Prior Publication Data

US 2012/0284945 A1 Nov. 15, 2012

(30) Foreign Application Priority Data

Jan. 26, 2010 (EP) ..... 10000699

(51) Int. Cl.
*A46B 3/04* (2006.01)
*A46D 3/04* (2006.01)

(52) U.S. Cl.
CPC ..... *A46D 3/045* (2013.01); *A46B 2200/1066* (2013.01)
USPC ..... 300/21; 15/167.1

(58) Field of Classification Search
USPC ..... 15/167.1; 300/21; 264/295, 339
See application file for complete search history.

(56) References Cited

U.S. PATENT DOCUMENTS

| | | | | |
|---|---|---|---|---|
| 4,128,910 | A | 12/1978 | Nakata et al. | |
| 7,162,767 | B2 * | 1/2007 | Pfenniger et al. | 15/167.1 |
| 7,921,499 | B2 | 4/2011 | Huber et al. | |
| 2001/0050507 | A1 | 12/2001 | Boucherie | |
| 2003/0159224 | A1 | 8/2003 | Fischer et al. | |
| 2006/0137120 | A1 | 6/2006 | Fischer et al. | |

(Continued)

FOREIGN PATENT DOCUMENTS

| | | | |
|---|---|---|---|
| DE | 200 06 311 | U1 | 8/2001 |
| EP | 1 908 370 | A1 | 4/2008 |

(Continued)

OTHER PUBLICATIONS

International Search Report issued in International Patent Application No. PCT/EP2010/007797 dated Mar. 16, 2011 (with translation).

(Continued)

*Primary Examiner* — Mark Spisich
*Assistant Examiner* — Andrew A Horton
(74) *Attorney, Agent, or Firm* — Oliff PLC

(57) ABSTRACT

In the production of toothbrushes, the neck part and the head part are bent relative to each other from the original shape thereof by a predetermined angle (α) in the hot state of the toothbrush body. Thereafter, the force applied to the toothbrush body by the stretching device in order to bend the toothbrush body is removed so that the toothbrush body can bend back into the original shape thereof. The risk of fractures, in particular brittle fractures, can be greatly reduced by said action. The method is advantageous, in particular, if the toothbrush body was heated during processing by ultrasonic welding.

14 Claims, 8 Drawing Sheets

(56) References Cited

U.S. PATENT DOCUMENTS

| | | | |
|---|---|---|---|
| 2008/0127439 | A1 | 6/2008 | Fischer et al. |
| 2008/0127440 | A1 | 6/2008 | Fischer et al. |
| 2008/0134452 | A1 | 6/2008 | Fischer et al. |

FOREIGN PATENT DOCUMENTS

| | | | |
|---|---|---|---|
| EP | 2 263 851 | A2 | 12/2010 |
| EP | 2 420 157 | A1 | 2/2012 |
| WO | WO 03/055351 | A1 | 7/2003 |
| WO | WO 03/086140 | A1 | 10/2003 |

OTHER PUBLICATIONS

Aug. 7, 2012 English translation of International Preliminary Report on Patentability issued in International Patent Application No. PCT/EP2010/007797.

* cited by examiner

METHOD FOR PRODUCING A TOOTHBRUSH AND TOOTHBRUSH

The present invention relates to a method for producing a toothbrush and to a toothbrush.

A method and a toothbrush of this type are known from publication WO 03/086140 A1. A carrier plate provided with bristles, and, if necessary, other cleaning elements, is inserted into a mount molded integrally on a head part of a toothbrush body, said carrier plate being fixed to the head part by means of ultrasonic welding. To test this fixation, a force is applied either directly or indirectly to the head region or to the carrier plate at the end of the tufting process once the body has cooled after the welding process, or the head part of the toothbrush body is bent slightly.

In particular with the use of transparent plastics for the toothbrush body, a risk of brittle fractures in areas subject to high mechanical load was determined, in particular in the end region of the head part facing the neck part and in the region of transition from the head part into the neck part. Brittle fractures are dangerous if they occur during use of the toothbrush, that is to say when teeth are being cleaned. The surface of the fracture may have sharp edges and corners, which have the potential to injure the user.

It was also determined that inaccuracies with regard to the fit in the region between the mount recess and the carrier plate, for example if the carrier plate is too large and the recess in the head of the toothbrush body is too small, may also have a negative influence on fracture behavior. Toothbrushes which are produced from hard materials which are conventional nowadays, such as polypropylene, are also affected by this.

The object of the present invention is to develop a generic method for the production of a toothbrush, in such a way that the risk of brittle fractures is practically eliminated, and to create a toothbrush produced by this method.

This object is achieved by a method having the features of a toothbrush body (12) having at least one head part (14) and a neck part (32) connected to the head part (14) and carrying it is produced, the head part (14) is provided with a carrier plate (20) carrying bristles (22) and the carrier plate (20) is fixed to the head part (14) by means of welding, and a force is then exerted on the toothbrush body (12), characterized in that the neck part (32) and the head part (14) are bent relative to one another from the original shape by a predetermined angle ($\alpha$), still in the hot state of the weld zone (51), by means of the force, and the force is removed after the bending process so as to allow the toothbrush body (12) to bend back into its original shape, and by a toothbrush having the features of a mount (16), formed integrally on the head part (14), for a carrier plate (20) and a carrier plate (20) provided with bristles (22) and inserted into the mount (16), said carrier plate being fixed to the head part (14) by means of welding, in particular ultrasonic welding, wherein either a gap (30), preferably of 0.03 mm to 0.35 mm, is provided between an outer surface (26) of the mount (16) and a lateral surface (28) of the carrier plate (20, or welding is substantially prevented.

In accordance with the invention, the neck part and the head part are bent relative to one another from the original shape thereof by a predetermined angle in the hot state in the weld zone between the toothbrush body and the carrier plate and the zone close to the weld. The bending process is carried out immediately after the welding process so that the weld zone and the zone close to the weld are still hot during said bending process.

After the bending process, the force is removed so that the toothbrush body can move back into the original shape thereof due to the resilient properties of the material thereof. By bending the neck part relative to the head part, the material of the toothbrush body and in particular of the weld zone between the toothbrush body and the carrier plate, and also partly of the zone close to the weld, is stretched in the region subject to high mechanical load, that is to say in the end portion of the carrier plate, relative to the neck part, which leads to orientation of the molecules and thus to improved fracture behavior in this zone.

For maximum effect, the resilient region of the toothbrush body, of the carrier plate and of the weld zone is preferably utilized practically fully during the bending process. Generally, no plastic deformation of these elements is caused by the described stretching process, this process being a resilient bending process, that is to say a reversible bending process.

The method according to the invention presupposes a connection process between the carrier plate and the toothbrush body, and therefore at least some of the material of the carrier plate and/or of the toothbrush body is melted, thus producing a weld zone by means of material connection.

In addition to ultrasonic welding, which is known in general, other welding or connection methods may also be considered in this instance. For example, a weld can be obtained by means of selective heating or friction. However, a weld can also be produced by means of injection molding, in which the plastic forming the toothbrush body is sprayed over the carrier plate. The material of the carrier plate is also melted locally by the encapsulating material, and a material connection is produced.

In the case of the welding methods described here, like or compatible materials are preferably used in the carrier plate and toothbrush body, at least in the relevant portions, so that a material connection can also be produced during the welding process, two hard materials preferably being welded.

Ultrasonic welding will be discussed hereinafter by way of example, although it is known that the fracture behavior can also be improved for other welding or connection methods by means of the method according to the invention.

The method according to the invention can also be used at other points of a toothbrush. For example, if the weld zone is not provided in the head part, but in the neck part or grip part of the toothbrush, the method according to the invention can be used in the relevant weld zone and zone close to the weld.

Tests have proven that the known risk of a brittle fracture is reduced considerably, if not prevented completely, by the method according to the invention, even with the use of opaque and in particular transparent plastics for the production of the toothbrush body.

The neck part is preferably deflected relative to the head part by an angle of 5° to 45°, in particular by 15° to 25°.

The deflection is further preferably maintained for a predetermined period of time before the force is removed. This period of time preferably lasts for approximately 0.3 seconds to 5 seconds, and in particular is selected between 0.5 seconds and 1.2 seconds.

It has been determined on the basis of tests that there is an increased risk of brittle fractures in particular if a carrier plate provided with bristles and/or rubbery-elastic massaging and cleaning elements has been inserted into a mount of the head part and if said carrier plate has been fixed to the head part by means of ultrasonic welding. As a result of the ultrasonic welding, the toothbrush body is heated in the weld zone and in the zone close to the weld due to vibrations, in particular in the head region and in an end portion of the neck region adjacent to the head region. The force for bending the neck part relative to the head part is particularly preferably applied immediately after the ultrasonic welding process whilst the toothbrush body is still hot in the weld zone and in the zone close to the weld as a result of the welding process.

In addition, the risk of fracture can also be prevented by providing a defined gap, which is open towards the front face, between an outer surface of the mount in the head part and a lateral surface of the carrier plate opposite thereto. This gap preferably measures 0.03 mm to 0.35 mm, in particular 0.05 mm and 0.18 mm.

This gap may have a different width over its length. The greatest width of the gap is preferably selected in an end portion of the mount facing the neck part.

Similarly, the risk of fractures can also be prevented by preventing welding of the carrier plate to the head part in a region between the outer surface of the mount and the lateral surface of the carrier plate by means of an adhesion reducer or an adhesion suppressor, preferably at least in the end portion of the mount facing the neck part.

The head part is preferably held in a receiving element whilst the force is applied to the neck part. The head part is more preferably supported in the receiving element over its lower face, facing away from the tufted upper face, along a peripheral edge portion, wherein the region of transition from the head region to the neck region is released.

For example, a sonotrode, by means of which the ultrasonic welding was carried out beforehand, or another element of the welding apparatus can be used to fix the head part in the receiving element. Furthermore, it is also possible to use another auxiliary device to fix the head part in the receiving element.

It is accordingly also possible to fix the neck part in an end region remote from the head part by means of a corresponding receiving element, and to apply the force to the head part so as to deflect said head part relative to the neck part by bending. If the toothbrush body has a grip part, the grip part is preferably held by means of the receiving element in the present case.

The toothbrush body and the carrier plate can be produced by conventional injection molding from a hard component. However, they can also be produced by two-component injection molding or by multi-component injection molding from one hard component and one or more soft components, or from two or more hard components and possibly one soft component. The hard component or hard components form the bearing part of the toothbrush body and of the carrier plate.

Different plastics can be used to implement the invention. Exemplary options from the field of thermoplastics include:

- styrene polymers, such as styrene acrylonitrile (SAN), polystyrene (PS), acrylonitrile butadiene styrene (ABS), styrene methyl methacrylates (SMMAs), styrene butadiene (SB, for example BDS K resin from Chevron Phillips Chemical Company);
- polyolefins, such as polypropylene (PP), polyethylene (PE), for example including those in high density polyethylene (HDPE) and low density polyethylene (LDPE) forms;
- polyesters, such as polyethylene terephthalate (PET) in the form of acid-modified polyethylene terephthalate (PETA) or glycol-modified polyethylene terephthalate (PETG) such as GN005 or 6763 from Eastman Chemical Company, polybutylene terephthalate (PET), acid-modified polycyclohexadimethanol therastalate (PCT-A) such as BR003 from Eastman Chemical Company, glycol-modified polycyclohexadimethanol therastalate (PCT-G) such as DN004 from Eastman Chemical Company;
- cellulose derivatives, such as cellulose acetate (CA), cellulose acetobutyrate (CAB), cellulose propionate (CP), cellulose acetate phthalate (CAP), cellulose butyrate (CB);
- polyamides (PA), such as PA 6.6, PA 6.10, PA 6.12;
- polymethyl methacrylate (PMMA);
- polycarbonate (PC);
- polyoxymethylene (POM);
- polyvinyl chloride (PVC);
- polyurethane (PUR).

Examples from the field of thermoplastic elastomers (TPEs) include:

- thermoplastic polyurethane elastomers (TPE-Us);
- thermoplastic styrene elastomers (TPE-Ss), such as a styrene ethylene butylene styrene copolymer (SEES) or styrene butadiene styrene copolymer (SES);
- thermoplastic polyamide elastomers (TPE-As), such as Grilflex from EMS Chemie AG;
- thermoplastic polyolefin elastomers (TPE-Os);
- thermoplastic polyester elastomers (TPE-Es).

In the case of a non-transparent brush, PP is preferably used as a hard component, and PP having a modulus of elasticity of 1000 to 2400 N/mm$^2$, preferably 1300 to 1800 N/mm$^2$, is most preferred. Polyesters such as the aforementioned BR003, CAP, PA, PMMA, SAN or ABS, are preferably used as a hard component to form a transparent brush.

A TPE-S is preferably used as a soft component. The Shore-A hardnesses of the soft plastic are preferably below 90 Shore A.

The invention will be explained in greater detail on the basis of an exemplary embodiment illustrated in the drawing.

In the drawing, in purely schematic form:

Figure 1:
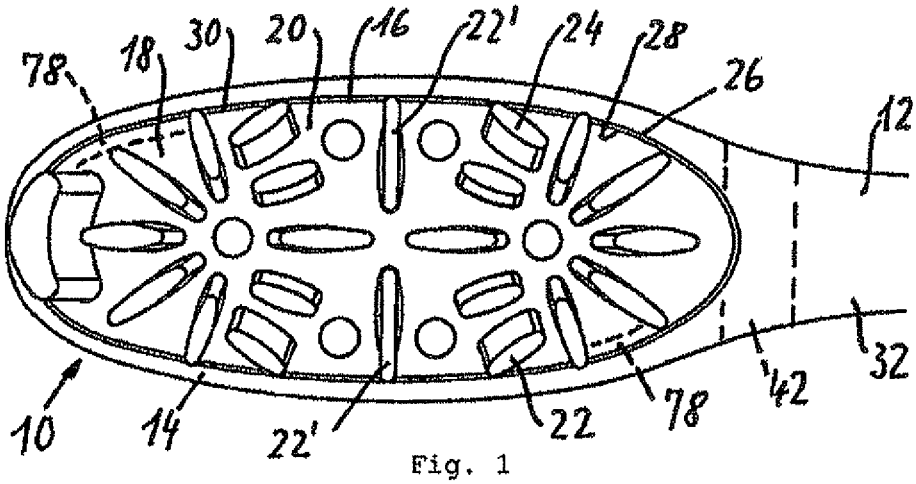
FIG. 1 shows a plan view of a region of a toothbrush according to the invention having a head part and an end region connected thereto of a neck part of a toothbrush body and a bristle carrier element, provided with bristles, inserted into the head part.
Figure 2:
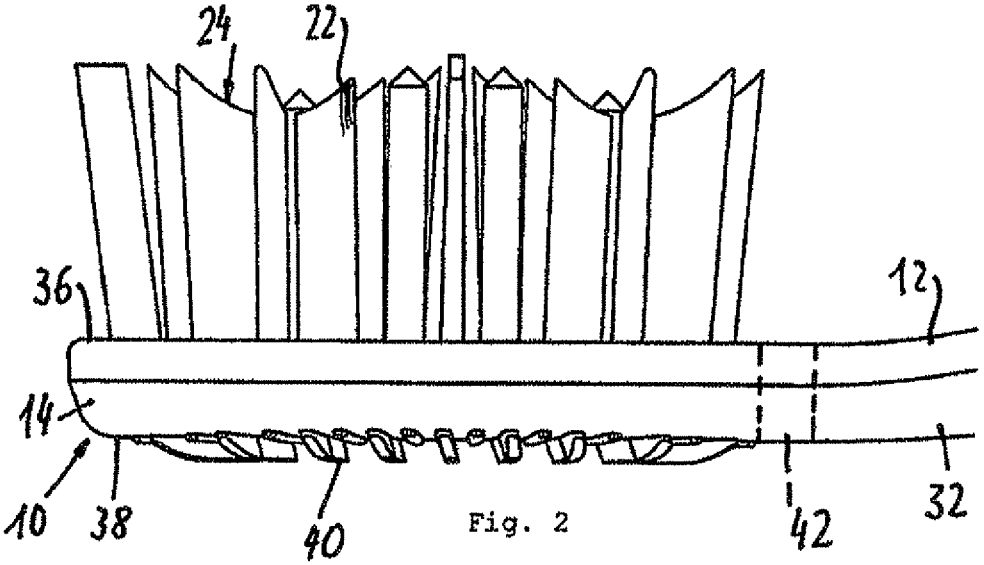
FIG. 2 Shows a side view of the region of the toothbrush shown in FIG. 1.

FIGS. 1 and 2 show part of a toothbrush 10 according to the invention with a toothbrush body 12 and a bristle carrier element 18, inserted into a mount 16 in a head part 14 of said toothbrush body and fixed to said head part 14. Said bristle carrier element has a carrier plate 20, from which the bristles 22 of a bristle field 24 protrude in a known manner.

As can be inferred from FIG. 1, the mount 16 has a peripheral outer surface 26 and the carrier plate 20 has a lateral surface 28 facing said outer surface. A peripheral gap 30, preferably an air gap, is provided between the outer surface 26 and the lateral surface 28.

Connecting to the head part 14, the toothbrush body 12 has a neck part 32 connecting integrally to said head part and of which only a portion facing the head part 14 is shown in FIGS. 1 and 2. In the case of a manual toothbrush, a grip part 34 connects to the neck part 32 on the side remote from the head part 14, this being illustrated in FIG. 9.

The bristles 22 of the bristle field 24 protrude from the carrier plate 20 on the front face 36 of the toothbrush body 12. The exposed surface of the carrier plate 20 is aligned with the corresponding surface of the toothbrush body 12.

In the embodiment shown in the figures, the head part 14 of the toothbrush body 12 is equipped with a tongue cleaner 40 on the rear face 38, facing away from the front face 36. Embodiments without a tongue cleaner 40 are also possible.

In the embodiment shown, the toothbrush body 12 consists in the neck part 32 and head part 14 of a hard component. It is also possible, however, for the tongue cleaner 40 made of a soft component to be injected integrally onto the hard component by two-component or multi-component injection molding, or for the soft component to be removed from relatively large surface portions of the surface of the toothbrush body 12, in particular including the head part 14, for decorative purposes.

A fracture point region 42 is also indicated in FIGS. 1 and 2, in which there is a risk of brittle fractures if the toothbrush body 12 is not stretched by bending the head part 14 relative to the neck part 32 in accordance with the present invention.

Figure 3:
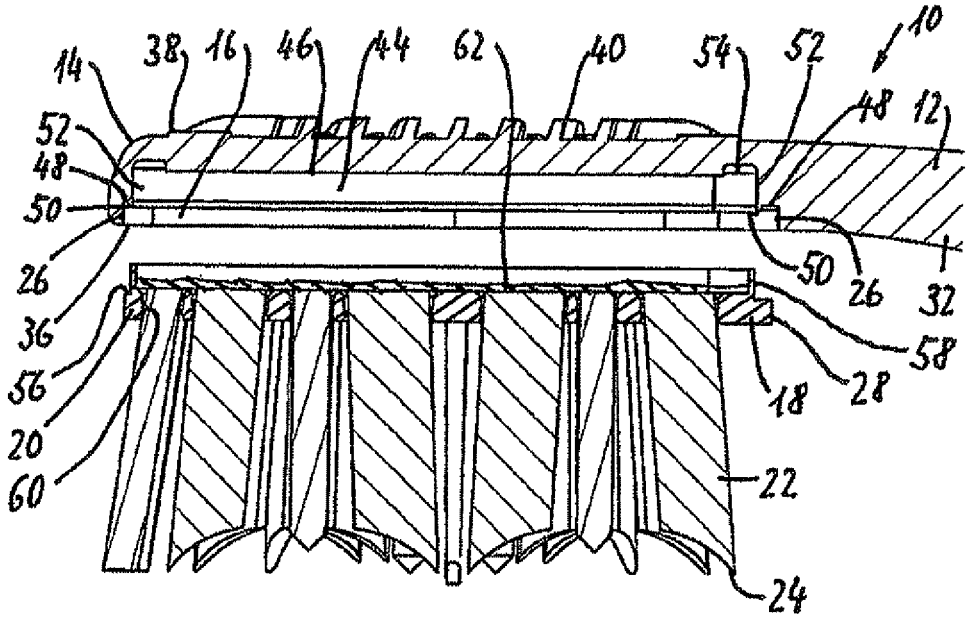
FIG. 3 shows an exploded longitudinal sectional view of the region shown in FIGS. 1 and 2 of the toothbrush with a toothbrush body and a tufted bristle carrier element.

FIG. 3 shows a central longitudinal sectional view of the same part of the toothbrush body 12 as illustrated in FIGS. 1 and 2, and also an exploded illustration of the bristle carrier element 18 with the bristles 22 of the bristle field 24 protruding therefrom.

The mount 16 is formed by a stepped recess 44 in the head part 14, said recess being open towards the front face 36 and the base 46 thereof being closed towards the rear face 38 by a wall of the toothbrush body 12.

The oval recess 44 in view from the front face 36 is defined from the front face 36 of the toothbrush body 12 as far as a step 48 by the outer surface 26, which in the present example extends in the head part 14 at right angles to the surface of the front face of the toothbrush body 12. The step 48 reducing the recess 44 extends in a plane parallel to the front face 36 of the head part 14, and a weld bead 50 acting as an energy concentrator/energy director protrudes from said step at a radially inward edge in the direction towards the front face 36. The cross-section of the weld bead 50, which is preferably completely peripheral and closed, is preferably triangular.

The weld bead 50 may also be formed differently, however. For example, the width (preferably not the height) may vary over the periphery. Furthermore, the weld bead 50 may have a shape which is interrupted in the peripheral direction, for example by successive individual weld points or by successive individual weld edges, wherein the distances and lengths of the elements may vary in both cases. For example, weld points may be pyramidal or conical. The height of the weld bead 50 is between 0.05 mm and 0.8 mm, preferably between 0.15 mm and 0.4 mm.

Adjacent to the weld bead 50, the recess 44 is defined by a lower, second outer surface 52, which preferably likewise extends at right angles to the front face 36 of the head part 14 or tapers slightly conically towards the base 46.

In the exemplary embodiment shown, the base 46 further has a peripheral, groove-like depression 54 in an edge region adjacent to the second outer surface 52.

It can also be inferred from FIG. 3 that the width of the step 48 is greater on the side facing the neck part 32 than on the side facing the free end of the head part 14. The width of the step 48 is between 0.6 mm and 2 mm, preferably 1 mm and 1.2 mm.

The step 48, measured from the base 46 to the front face 36 of the head part 14, is arranged at most at 70%, preferably at most at 66%, of the overall height, wherein 50% or less is also conceivable. The weld bead 50 and the weld zone 51 produced later are therefore positioned as close to the base 46 as possible.

The depth of the recess 44, that is to say the distance from the front face 36 to the base 46, is 1.8 mm to 2.6 mm, preferably 2.1 mm to 2.3 mm. The groove-like depression 54 has a depth, measured from the front face 36, of 2.5 mm to 3.5 mm, preferably of 2.8 mm to 3.2 mm. The height of the step 48, measured from the front face 36, is between 0.6 mm and 2 mm, preferably between 1 mm and 1.2 mm.

The carrier plate 20, which is flat over the front face 36 in the exemplary embodiment shown, is shaped in such a way that its peripheral lateral surface 28, in the assembled state, extends at least approximately parallel to the outer wall 26 and at a distance therefrom, thus forming the gap 30. This means that the shape of the recess 44 is adapted to the shape of the carrier plate 20 and of the bristle carrier element 18. The two may consequently also have shapes which differ geometrically, but which in any case have to be matched to one another.

A stepped, flat counter-surface 56 corresponding to the step 48 is also formed on the carrier plate 20 and is defined radially inwardly by a centering wall 58, which protrudes from the carrier plate 20 on the rear face thereof. The radially outer surface of the centering wall 58 mirrors the second outer surface 52 and the mount 16 and centers the bristle carrier element 18 in the toothbrush body 12.

So that the width of the gap 30 can also always be maintained in practice, it is necessary to tolerate accordingly the tools used to produce the toothbrush body 12 and the recess 44 and the carrier plate 20. To this end, the tolerances of the carrier plate 20 and of the recess 44 in the toothbrush body 12 have to be matched to one another in the region of the mount 16 so that the carrier plate 20 when formed with maximum size, in combination with the recess 44 in the toothbrush head when formed with minimum size, still form the gap 30 with the given dimension. This means that the tolerances of the centering wall 58, the inner edge and outer edge of the counter-surface 56, and the tolerance of the lateral surface 28 have to be matched to one another and to the recess 44 and mount 16 in the toothbrush body 12 on the side of the carrier plate 20. In the toothbrush body 12, the tolerances of the inner and outer edges of the step 48 and of the outer surface 26 have to be matched to one another and to the aforementioned tolerances of the carrier plate 20.

With regard to the peripheral centering wall 58, the carrier plate 20 has bristle-receiving openings 60 arranged radially inwardly and penetrating from the front face of the carrier plate 20 to the rear face thereof.

As is generally known from the AFT (anchor free tufting) method, the bristle carrier element 18, for example the carrier plate 20, is produced by injection molding, in the present case preferably from a hard component. Cleaning and massaging elements 22' made of a soft component can also be injected integrally onto the carrier plate 20. The bristles 20 forming the bristle field 24 are guided through the bristle-receiving openings 60 in the carrier plate 20 and are aligned so as to form the tooth cleaning geometry. The bristles 20 are then melted in their end region projecting beyond the rear face of the carrier plate 20, for example by means of a punch, whereby a melt film 62 of molten bristle material is formed on the rear face of the carrier plate 20 and within the region defined by the centering wall 58. The tufted bristle carrier element 18 is thus formed by means of the bristles 22.

The tufted bristle carrier element 18 is then inserted into the mount 16 of the toothbrush body 12 from the front face 36, until the counter-surface 56 of the carrier plate 20 comes to rest against the weld bead 50 of the mount 16 of the head part 14. Centering occurs by cooperation of the centering wall 58 with the second outer surface 52 or the edge thereof terminating in the direction of the front face 36. When melting the bristles 22 in practice to form the melt film 62, the centering wall 58 is thus inclined radially inwardly due to the effect of the heat. The result of this change in geometry caused by the process is that the centering wall 58 forms a quasi run-in bevel towards its starting point, and the terminal edge in the region of the counter-surface 56 is thus used for the centering process.

Figure 4:
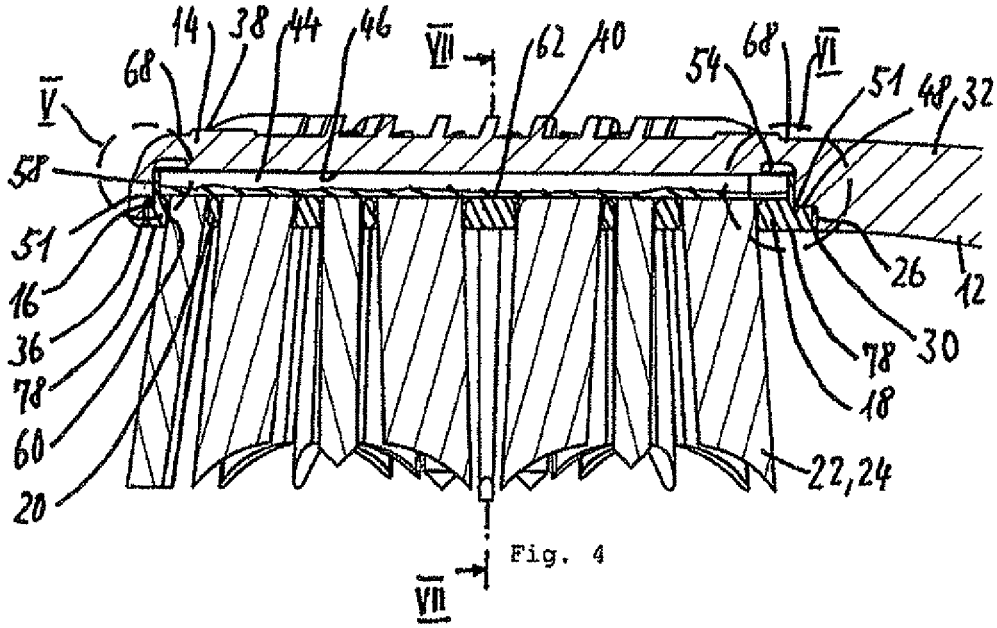
FIG. 4 shows a longitudinal sectional view of the region of the toothbrush according to FIGS. 1 and 2 with a tufted bristle carrier element inserted into the head part.

As can be seen in particular from FIG. 4, the depression 54 prevents the terminal surface of the centering wall 58, arranged on the rear face, from contacting the base 46.

Once the tufted bristle carrier element 18 has been inserted into the mount 16 of the head part 14, the carrier plate 20 is connected rigidly in a known manner to the toothbrush body 12 by means of ultrasonic welding. The weld bead 50 on the toothbrush body 12 is used as an energy concentrator/energy director. It is liquefied during the process of ultrasonic welding and produces a welded connection together with the material of the carrier plate 20 in the region of the counter-surface 56 thereof, thus forming a weld zone 51. The melt may spread in the region of the step 48 and may also melt regions close to the weld bead 50, wherein penetration into the gap 30 is preferably prevented. The process of ultrasonic welding is preferably carried out between two compatible hard components which allow a material connection, preferably between two same hard components.

As is clear in particular from FIGS. 5 to 8, this welded connection is uninterrupted in a peripheral direction. Furthermore, it can be inferred from these figures that, once the ultrasonic welding process is complete, the counter-surface 56 and the step 48 rest against one another. It can also be inferred particularly clearly from these figures that the peripheral gap 30 remains between the outer surface 26 of the toothbrush body 12 and the lateral surface 28 of the carrier plate 20 and is open towards the front face 36.

Figure 15:
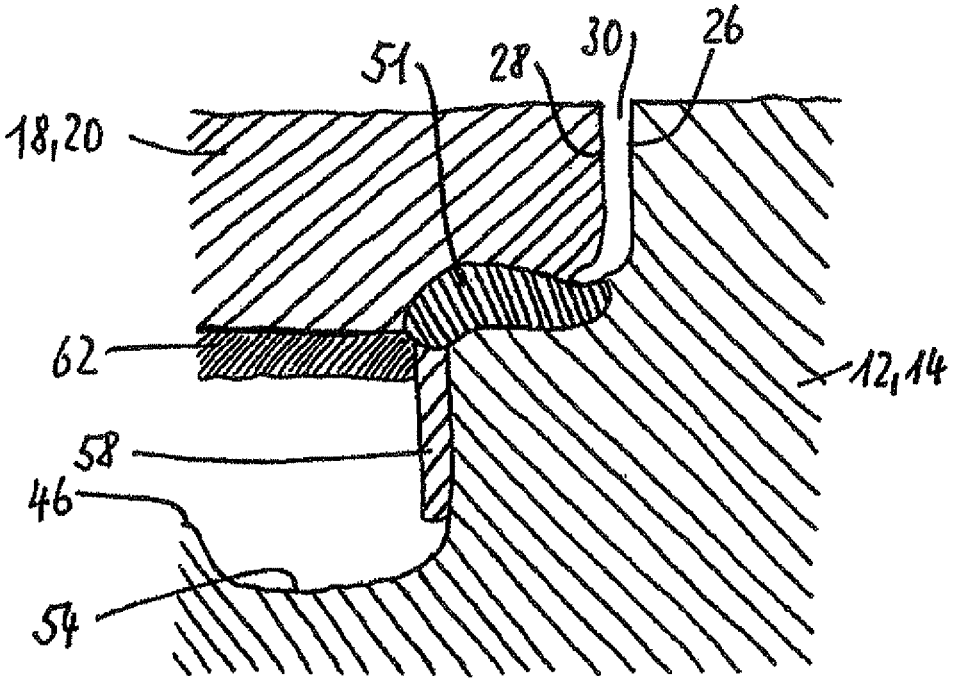
FIG. 15 shows an enlarged detail of the interface between the carrier plate and toothbrush body, as shown in the various preceding figures, with the weld zone and the zone close to the weld.

With regard to the weld zone 51 shown in FIGS. 5 to 8, it should be noted that this has been illustrated in a stylized and simplified manner in the form of a weld bead 50 dipping into the carrier plate 20. This means that the two elements are shown as an overlap. In practice, however, this is not the case, and an illustration corresponding to the situation in practice is illustrated in FIG. 15. The weld bead 50 has been melted. The material thereof and also the weld energy acting thereon also heat and melt regions of the carrier plate 20 and of the mount 16 close to the weld bead 50. This melting process ultimately provides a material connection between the toothbrush body 12 and the carrier plate 20. The material in the regions close to the weld zone 51 is also heated due to the welding process, this region being referred to as the zone close to the weld.

Figure 5:
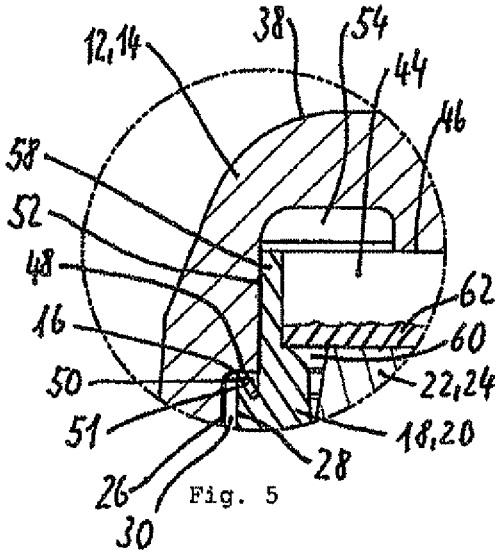
FIG. 5 shows a longitudinal sectional view, enlarged compared to FIG. 4, of a detail of the toothbrush denoted by V in FIG. 4.
Figure 6:
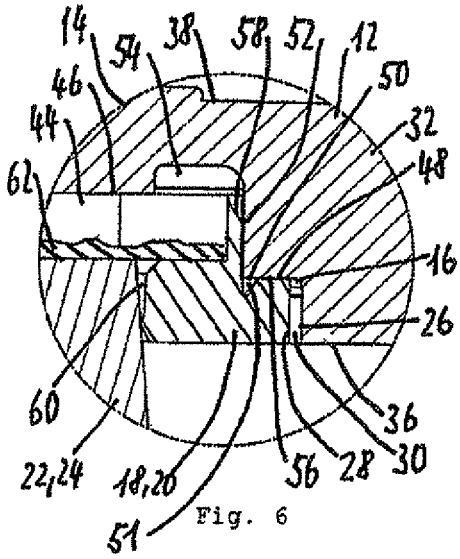
FIG. 6 shows a further detail of the toothbrush, denoted by VI in FIG. 4, in the same illustration as in FIG. 5.
Figure 7:
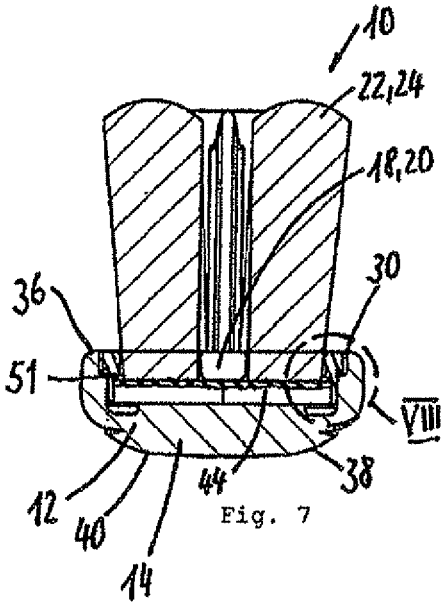
FIG. 7 shows a cross-sectional view through the toothbrush along line VII-VII in FIG. 4.
Figure 8:
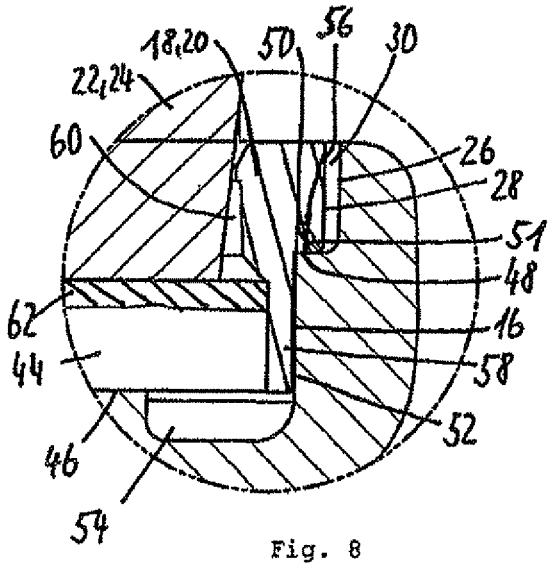
FIG. 8 shows a side detail of the toothbrush denoted by VIII in FIG. 7 in a view enlarged compared to said figure.

So as to ensure, in particular in an end region, facing the neck part 32, of the recess 44 or of the mount 16, that the gap 30 remains free from weld melt as far as the step 48, the step 48 is wider in this region and the distance between the outer wall 26 and the weld bead 50 is preferably greater than in the other regions; to this end see FIGS. 5, 6 and 8 in particular, which show an end portion of the mount 16 facing the free end region of the head part 14, an end portion of the mount 16 facing the neck part 32, and the mount 16 in the longitudinal center of the head part 14.

Figure 9:
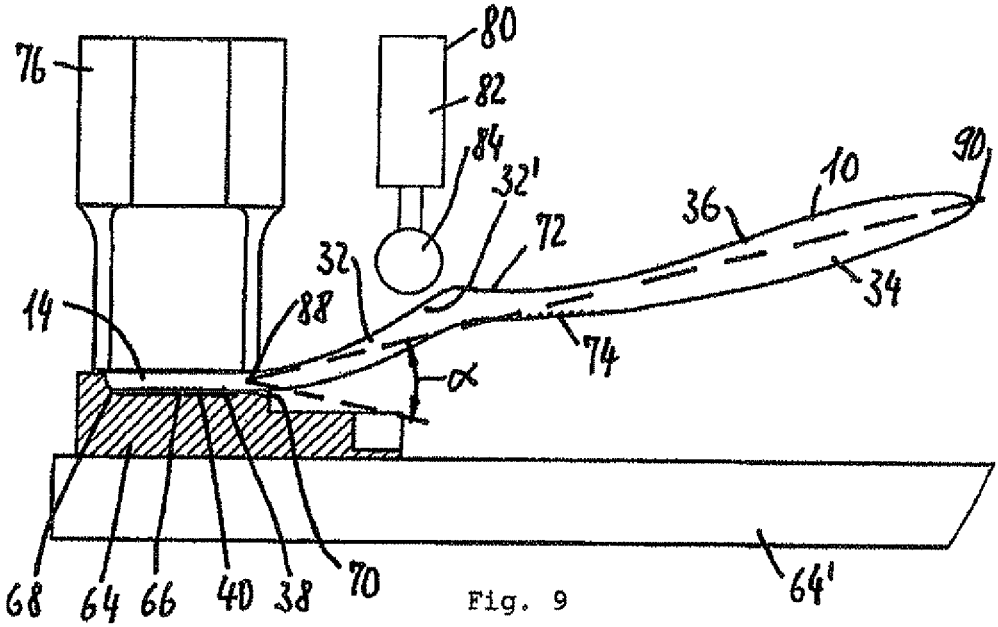
FIG. 9 shows a partly cut-away view of part of an apparatus for bending the neck part relative to the head part.

FIG. 9 shows a radially outer edge portion of a round table 64', which is rotatable in an indexed manner about a vertical axis and on which a receiving element for the head part 14 of a toothbrush body 12 is fixed and distributed in the peripheral direction, for example offset by 90° in each case. The receiving element 64 is also illustrated in plan view in FIG. 10, enlarged compared to FIG. 9. The receiving element 64 has a receiving depression 66, which is open in an upwards direction and which supports the head part 14 over the rear face 38 in a support portion 68 extending around the tongue cleaner 40. The receiving depression 66 is recessed radially inwardly of the support portion 68 so as to release the tongue cleaner 40.

If the toothbrush is formed without a tongue cleaner, the shape of the receiving depression 66 may follow the geometry of the rear face of the toothbrush head, release being possible, but not absolutely necessary. In the vertical direction, the receiving depression 66 supports the head part 14 of the toothbrush at a height of 40% to 70% of the overall height of the toothbrush body 12 in the head part 14.

As can be seen in comparison with FIG. 4, the support portion 68 extends over the rear face 38, at least in the vicinity of the region of the step 48 and of the weld bead 50, viewed in a projection at right angles onto the front face 36.

Figure 10:
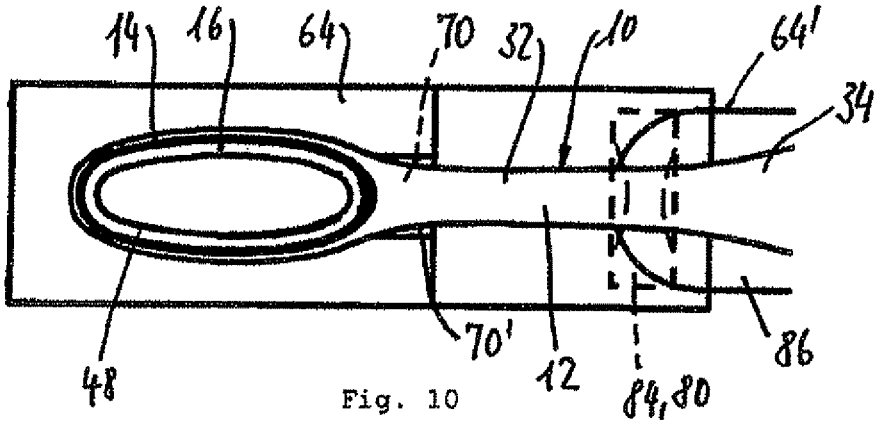
FIG. 10 shows a plan view of part of the apparatus according to FIG. 9 with a toothbrush inserted via its head part into a receiving element of the apparatus.

As can also be inferred from FIGS. 9 and 10, a release depression 70 extends from the receiving depression 66 to the free edge of the receiving element 64 and releases the toothbrush body 12 in the region of transition from the head part 14 to the neck part 32 and releases, the neck part 32. The release depression 70 ends at least approximately at the end, on the neck part side, of the mount 16 or of the recess 44 for the bristle carrier element 18.

The end of the release depression 70 is preferably adapted in such a way that the step 48 and the weld bead 50 lie in line with the support portion 68, at least at right angles to the front face 36, the release depression 70 preferably lying directly against the support portion 68. It is thus ensured that the mount 16 or the weld bead 50 is supported during the process of ultrasonic welding in the region at right angles to the front face 36, thus enabling optimal welding and yet not impairing the bending process.

In addition to the release depression 70, the lateral release region 70' is also illustrated in FIG. 10. This releases the toothbrush body perpendicular to the direction of release of the release depression 70, in the present case in a plane parallel to the front face 36 of the carrier plate 20. The release of the neck part 32 of the toothbrush body 12 allows the toothbrush body 12 "to move freely" during the bending process. In principle, a clearance is thus created for displaced material so that said material is not obstructed by a mount of the device.

At the earliest, the lateral release 70' is implemented from a region 75% the length of the carrier plate 20, measured from the free end of the bristle field 24. So that the welding process is carried out in an optimal manner and so that a possibility for material displacement is also provided on the front face 36 of the toothbrush body 12, a sonotrode 76 may be formed in such a way that it is easily released at the end located in the direction of the toothbrush body 12, towards the support portion.

The toothbrush 10 is shown with the head part 14 inserted into the receiving depression 66, with the rear face 38 inserted first, whilst the neck part 32 and the grip part 34 connecting thereto are free. It should be mentioned at this juncture that the grip part 34 may have, for example, a thumb rest 72 and an index finger rest 74 made of a soft component. It should also be mentioned that regions of the neck part 32 and/or of the head part 14 and/or of the grip part 34 may also be equipped in a known manner with a soft component.

The sonotrode 76, with which the bristle carrier element 18 provided with bristles 22 and the head part 14 or the toothbrush body 12 are welded together in a welding station of the toothbrush production device, can also be seen in FIG. 9.

The sonotrode 76 is annular, at least in its end region facing the receiving element 64, that is to say it is formed with a cavity inside for the bristle field 24. This is indicated in FIGS. 1 and 4 in the form of a contact surface 78 of the sonotrode 76 on the carrier plate 20. This contact surface 78 runs around the bristle field 24 in a line over the weld bead 50 in the head part 14 of the toothbrush. The bristles 22 projecting beyond the carrier plate 20 and, where applicable, the rubbery-elastic cleaning elements find space in the cavity in the sonotrode 76.

The bending process is indicated in FIG. 9. A support is introduced beneath the grip part 34 during the prior welding process or whilst the receiving element 64 rotates together with the round table 64', said support supporting and guiding the toothbrush body 12. This support is not shown in the figure and is removed or moved away for the bending process.

The welding station is also assigned a stretching device 80, which is intended to bend the neck part 32 relative to the head part 14, from the original shape shown in FIG. 9, by the angle α and then to release it again after a specific waiting period. In the exemplary embodiment shown, the stretching device 80 has a cylinder/piston assembly 82, of which the piston is provided at the free end with a roil 84.

The direction of movement of the roll 84 extends orthogonal to a plane defined by the front face 36 of the carrier plate 20 and of the head part 14. The stretching device 80 is also arranged in such a way that the roll 84 comes to rest against the front face in an end region 32' of the neck part 32 remote from the head part 14 and arranged at the grip part 34. Due to the extension of the cylinder/piston assembly 82, the roll 84 presses onto the surface of the toothbrush body 12, rolls over it and deflects the body by the angle α.

If, by rotating the round table 64', a receiving element 64 fitted with a toothbrush body 12 provided with a bristle carrier element 18 reaches the welding station, the sonotrode 76 is lowered onto the carrier plate 20 of the bristle carrier element 18, and the ultrasonic welding process is carried out between the carrier plate 20 and the head part 14 in a known manner by excitation of the sonotrode 76. Once the time necessary for the welding process has elapsed, the sonotrode 76 (in an unexcited state) remains in contact with the bristle carrier element 18 so as to hold the head part 14 during the subsequent stretching process. To stretch as a result of bending, the roll 84 is contacted against the end region 32' of the neck part 32 in the manner of a ram by control of the cylinder/piston assembly 82 and is then lowered further by a predetermined stroke so as to bend the neck part 32 relative to the head part 14 by the angle α. After a predetermined period of time, during which the roll 84 is held in the lowered position, the roll 84 is withdrawn again into the starting position by means of the cylinder/piston assembly 82 so that the toothbrush body 12, due to its resilience, can bend back again into the original shape.

The surface of the roll is concave so that it guides the neck part 32 of the toothbrush body 12 in an optimal manner and the deflection occurs in a direction perpendicular to the bristle field 24. It is thus ensured as a result of the shape of the roll that the toothbrush body 12 does not turn.

It should be mentioned at this juncture that it is also conceivable to provide a second ram to assist the return movement of the toothbrush body 12 into the original shape thereof. The design of the second ram for the return movement is determined by two factors: the speed of the return movement and the effective position after the return movement. If the speed of the return movement is too slow, the cycle of the machine will be slowed, which means that the cycle time will be greater, thus leading to poorer efficiency with weaker ejection. By contrast, the second factor (the position after the return movement) plays a role in that the support is again brought into the original position after the stretching process. If, at this moment, the toothbrush is not in the same position as originally, this may lead to disturbances in the machine and may thus affect the consistency of the process.

It is also possible to design the roll in a manner other than that described. Systems which are not rotatable and which rest against the surface of the toothbrush body 12, preferably with low friction, are also conceivable. Geometrically, plates having rounded edges are thus also conceivable as a pressing element, similarly to the roll. However, it is preferable for these alternative elements to be provided with a layer having low frictional resistance.

The neck part 32 is bent relative to the head part 14 immediately once the welding process is complete so that the toothbrush body 12 is still hot, at least in the head part 14 and in an end portion of the neck part 32 connecting thereto, that is to say in the zone close to the weld and in particular in the weld zone 51. The exact temperature cannot be specified, since there is a distribution of temperature over the toothbrush body in the region of the weld. Temperatures around the melting point of the material are thus reached at the moment of welding in the region of the weld bead 50. This heat irradiates into the surrounding environment and thus also heats regions of the body not affected directly.

The angle α is selected between 5° and 45°, and preferably lies in the range of 15° to 25°. The angle α is defined by the virtual line from the bending axis to the free end 90 of the grip part 34, more specifically as an angle between the original state and the deflected state. The release depression 70 and an opening or a depression 86 in the round table 64' (see FIG. 10) allow collision-free bending about this angle.

The resilience of the toothbrush body 12 is disregarded when considering, the angle, that is to say it is assumed that the toothbrush body behaves rigidly beyond the bending zone; no correction factor is introduced for the resilience. In principle however, the resilience is less if the stretching device is effective closer to the point at which the head part 14 is clamped.

The bending axis extending at least approximately parallel to the front face 36 of the head part 14 and at right angles to the longitudinal axis of the toothbrush body 12 and about which the toothbrush body 12 bends as a result of the force exerted thereon by means of the stretching device 80 lies at least approximately at the transition from the head region to the neck region, that is to say approximately in the region denoted in FIG. 1 by the fracture point region 42, in which the risk of a brittle fracture is at its greatest. The bending process takes place within a narrow region, as viewed in the longitudinal direction of the toothbrush 10, in which the bending axis 88 is located. The length of the region is between 1 mm and 10 mm, preferably between 2 mm and 5 mm, measured from the position of the weld bead 50 over the longitudinal axis of the toothbrush 10 in the direction of the neck part 32 of the toothbrush body 12.

The distance between the last bristles 22 over the longitudinal central axis of the bristle field 24 and the point at which the stretching device 80 acts on the toothbrush body 12 is 20 mm to 60 mm, preferably 30 mm to 50 mm. The point at which the stretching device 80 acts on the toothbrush body 12 preferably lies in front of the thumb support 72.

The speed with which the stretching device 80 acts on the toothbrush body 12 so as to bend it by the angle $\alpha$ is controlled by a throttle on the cylinder/piston assembly 82 or in the supply thereof and is selected in accordance With the conditions.

The start of the stretching process is preferably controlled by the position of the sonotrode 76. Between 0.1 seconds and 0.8 seconds, preferably 0.2 seconds, after the sonotrode 76 has reached its end position in the welding process, the welding process still taking place however, the stretching process is begun as the support is moved away and the ram is subsequently extended.

The toothbrush body 12 is held for 0.3 seconds to 2 seconds, preferably between 0.5 seconds and 1.2 seconds, in the deflected position (stretching position). The entire additional process, that is to say from the moment at which the vibration of the sonotrode 76 is stopped until the moment at which the sonotrode is raised, is referred to as the holding period. In an integrated stretching process, this holding period lasts between 0.8 seconds and 2 seconds, preferably 1 second. No losses in efficiency therefore have to be endured during the stretching process, and the machine therefore does not have to endure any extension of the cycle time. However, the holding period used in the invention is greater than the holding period in the "normal" process, in this case it lies specifically in the range of 0.1 seconds to 0.8 seconds, preferably 0.2 seconds to 0.5 seconds.

Generally, the cycle time for the welding and stretching processes should be quicker than the cycle time for tufting a carrier plate 20 (machine cycle time) in the case of in-line production.

The width of the gap 30 between the head part 14 and the carrier plate 20, that is to say between the lateral surface 28 of the carrier plate 20 and the outer surface 26 of the mount 16, is selected between 0.03 mm and 0.35 mm, preferably between 0.08 mm and 0.18 mm. The gap 30 is preferably wider in its end portion facing the neck part 32 than in the lateral portions and in the end portion facing the free end of the head part 14. The width of the gap 30 is preferably 0.1 mm to 0.2 mm in the end portion facing the neck part 32, is 0.09 mm to 0.19 mm in the end portion facing the free end, and is 0.03 mm to 0.35 mm, preferably 0.05 mm to 0.18 mm, in between in the lateral portions. The gap width preferably changes continuously. However, it is also conceivable to form a gap 30, which has a constant peripheral width in the range between 0.03 mm and 0.35 mm, preferably between 0.08 mm and 0.18 mm.

Figure 11:
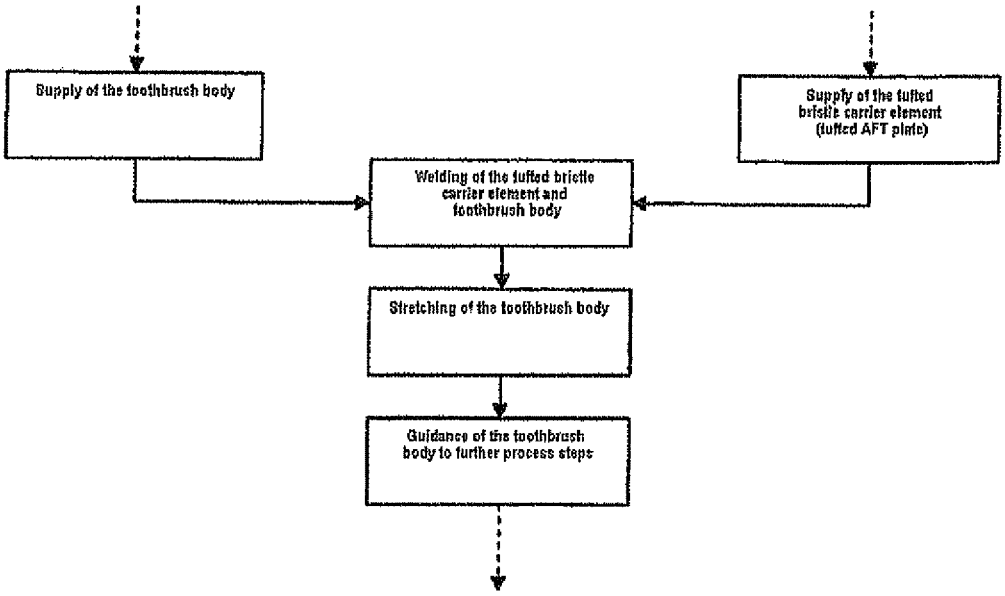
FIG. 11 shows a basic flow diagram for the method according to the invention.

According to the general flow diagram of FIG. 11, which shows the integration of the invention in the AFT method, the toothbrush body 12 produced by injection molding (normal injection molding, two-component injection molding or multi-component injection molding) in a manner which is known in general and the bristle carrier element 18 produced by injection molding (normal injection molding or two-component injection molding) in a manner which is known in general and tufted by the AFT method (tufted AFT plates) are supplied, and the tufted bristle carrier element 18 brought together with the head part 14 of the toothbrush body 12 is then welded, preferably by means of ultrasonic welding. The toothbrush body 12 heated by the welding process is then stretched immediately after, whilst still hot from the welding process, by bending the head part 14 relative to the neck part 32, for example as has been described in greater detail above in conjunction with FIGS. 9 and 10. After the stretching process, the toothbrush 10, which is now again in its original shape, is supplied for further process steps, for example for packing, inscription, or the like.

It should be mentioned at this juncture that the stretching process is provided immediately after the welding process due to the fact that the zone close to the weld and the weld zone 51 are still hot, but can also be carried out elsewhere. In other words, the above-described embodiment by means of a stretching process at the welding station is understood to be exemplary.

Figure 12:
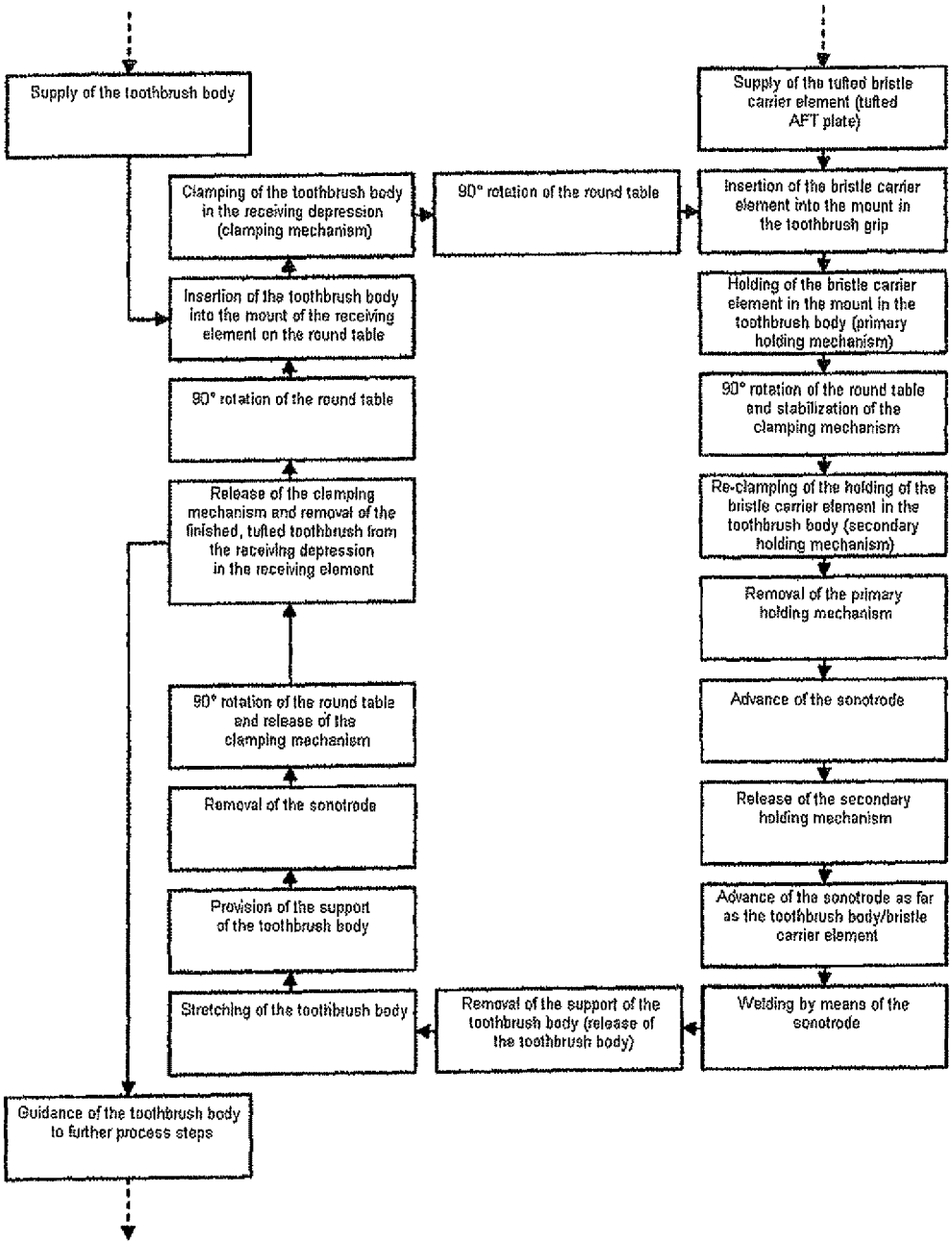
FIG. 12 shows a flow diagram for carrying out the method according to the invention on a round table by the AFT method.

The flow diagram of FIG. 12 illustrates in detail a possible embodiment of the bringing together of the toothbrush body 12 and the tufted bristle carrier element 18, of the ultrasonic welding, and of the subsequent bending for stretching purposes. This sequence shows, inter alia, the application of the invention to an existing machine, which tufts the toothbrush by means of the AFT method.

The toothbrush body 12 is supplied to the round table 64' and is placed in the receiving depression 66 of a receiving element 64 on the round table 64' (see FIG. 10). The toothbrush body 12 is clamped in the region of the neck part 32 or of the grip part 34 on the receiving element 64 and on a support (not shown) in the grip part 34 by means of a clamping mechanism. The round table 64' (in particular, see FIG. 9 also) is then turned through 90° for example. A supplied tufted bristle carrier element 18 is placed in the mount 16 or recess 44 of the head part 14 in the insertion station thus reached; see FIGS. 3 and 4.

The bristle carrier element 18 inserted into the toothbrush body 12 can be fixed in the mount 16 by means of a "primary holding mechanism". The round table 64' is rotated further, for example again through 90°, whilst the bristle carrier element is fixed in this manner. At the same time, the clamping mechanism, which clamps the toothbrush body 12 onto the support, is mechanically released a little and stabilized, so that it exerts merely a light pressure onto the toothbrush body 10, said pressure not increasing further. It is thus ensured, in this position of the round table 64', that the clamping mechanism has no further influence on the process.

A re-clamping process may then be carried out, in which a "secondary holding mechanism" for holding the bristle carrier element 18 is moved theretowards and then the primary holding mechanism is moved away therefrom. In addition to holding the bristle carrier element 18, the secondary holding mechanism is also used to press the bristles 22 over the bristle field 24 in the direction of the center of the bristle carrier element 18. Space is then created so that the sonotrode 76 (see FIG. 8) can be moved towards the carrier plate 20, preferably by being lowered, and so that the bristles 22 are introduced into said cavity in the sonotrode 76 whilst the sonotrode 76 is being lowered. The secondary holding mechanism is then released so that the sonotrode 76 can be advanced as far as the carrier plate 20 or head part 14. It should be mentioned at this juncture that it is not absolutely necessary to change from the primary holding mechanism to the secondary holding mechanism. Embodiments of the course of the method and of the respective devices in which there is only one holding mechanism, which combines the above-mentioned functions of the two holding mechanisms, are also conceivable.

The welding process is then carried out for a predetermined period of time, for example from 0.03 seconds to 0.8 seconds, preferably from 0.05 seconds to 0.2 seconds, in particular 0.08 seconds, as a result of the known corresponding excitation of the sonotrode 76. Up until this moment, the grip part 34 is preferably supported by means of a support (not shown in the figures). If this was the case, this support is moved away at this point so that the grip part 34 is released. Since the clamping mechanism has been released, the toothbrush body 12 is no longer loaded once the support has been moved away.

In the method step of "stretching the toothbrush body", the neck part 32 is bent relative to the head part 14 by the angle $\alpha$ by corresponding control of the cylinder/piston assembly 82, as described further above, is held in this deflected position for the period mentioned and is then released again. The toothbrush body 12 can move back into its original shape automatically due to its resilience. This process of moving back can be assisted, however, by delivery of the previously mentioned support to the grip part 34 or by other aids. For the stretching process, the sonotrode 76 may be raised from the welding position by 0.1 mm to 0.5 mm, preferably 0.2 mm to 0.3 mm. Space can thus be created so that the toothbrush body 12 can expand during the stretching process at the corresponding points. The position preferably is not changed, however, and the sonotrode 76 remains in the position in which the welding process was concluded. If necessary, the position can be changed by forces, which act on the sonotrode 76 from the stretching process and through, the toothbrush body 12.

The sonotrode 76 is then moved away from its position in contact with the bristle carrier element 18, for example by being raised, and the round table 64' is rotated, for example through a further 90°. The clamping mechanism is released again, either in parallel with the onset of the rotational movement or just before, so that it again holds the toothbrush body 12 on the receiving element 64 and the support under full pressure, inter alia even during rotation of the round table 64'. Only at a removal station is the clamping mechanism released and the toothbrush released. The finished, tufted and stretched toothbrush 10 is then removed from the receiving element 64 and from the support and is supplied to the further process steps, for example by means of a robot or manipulator.

If the bristles 22 have not been rounded beforehand, a further process step consists for example in rounding the ends of the bristles 22 in a known manner. Another further process step may consist in inscribing or printing or embossing the toothbrush body 12. A further process step may consist in packing the toothbrush 10.

Figure 13:
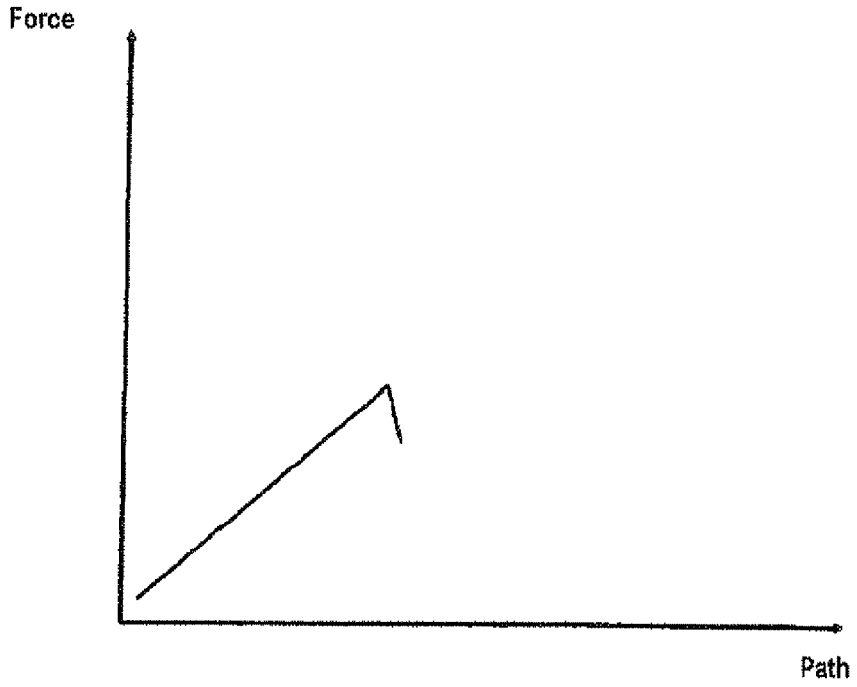
FIG. 13 shows a path/force graph during loading of a toothbrush without stretching.

FIG. 13 illustrates a path/force graph as an example of the behavior of a toothbrush 10, of which the toothbrush body 12 has not been stretched by bending the head part 14 relative to the neck part 32. For the measurement, the grip part 34 of the toothbrush is fixed as far as the thumb support 72 and index finger support 73, and a force is applied to the head part 14, for example centrally, said force being oriented identically during the entire test and being directed in the unloaded state onto the carrier plate 20 at right angles to the front face 36. The force increases approximately proportionally to the deflection (=path), until it causes a fracture, usually at the transition from the neck part 32 to the head part 14 (see the fracture point region 42 in FIG. 1). This can be identified in particular by the sudden change in the path/force graph.

Figure 14:
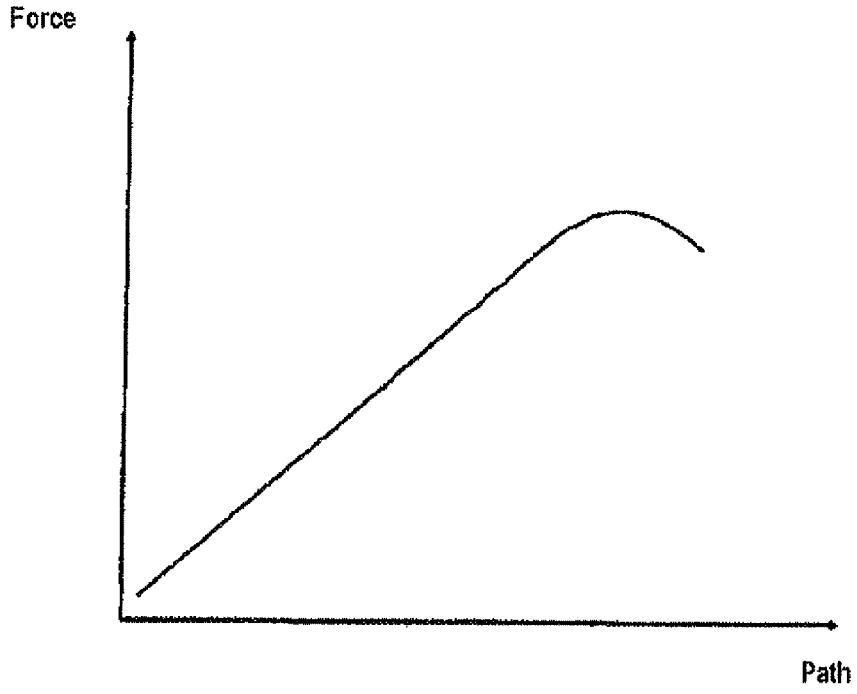
FIG. 14 shows a path/force graph, in the same illustration as FIG. 13, during loading of a toothbrush of which the toothbrush body has been stretched in accordance with the invention.

FIG. 14 shows the path/force graph for a toothbrush 10 produced in accordance with the present invention, of which the toothbrush body 12 has been stretched, as described further above. Due to the effect of force on the head part 14 when the grip part 34 is fixed, the region of the approximately linear correlation between deflection (path) and force is approximately twice that when the toothbrush body 12 is not stretched (see FIG. 13), and there is no fracture, but instead plastic deformation. This can be seen in the graph due to the round shape of the curve and is a desired result of the invention.

With regard to the force/path measurement, it should also be noted that the force required for deflection, that is to say for the stretching process, does not play any role and is not considered. Merely the angle $\alpha$ reached is of importance.

Figure 16:
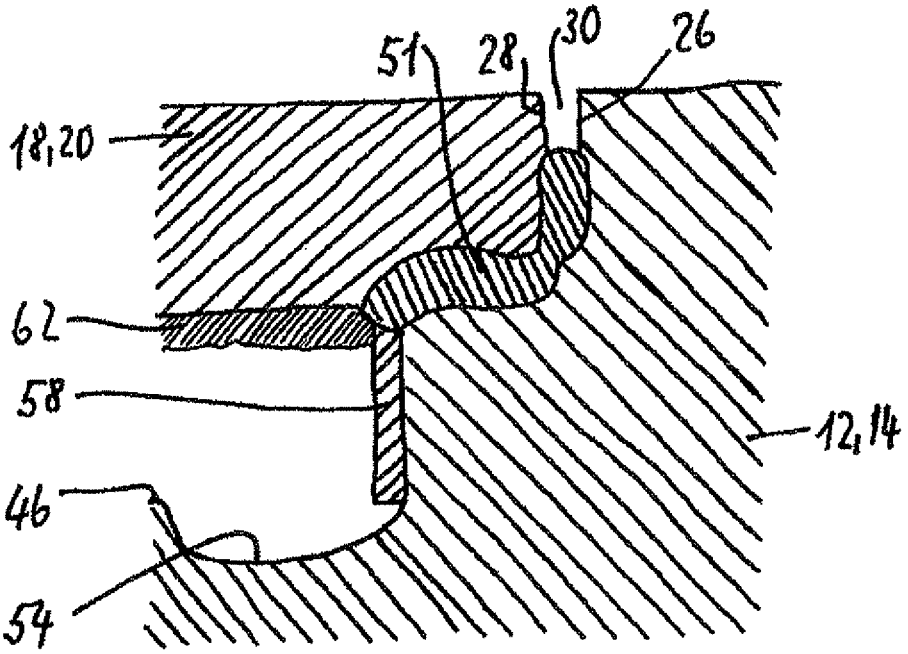
FIG. 16 shows an enlarged detail of the interface between the carrier plate and toothbrush body, as shown in the various preceding figures, wherein the material flow in the gap is shown.

FIGS. 15 and 16 illustrate a sectional view showing how the interface between the carrier plate 20 and the toothbrush body 12 may appear after the connection process by means of welding. The illustrations are based on analyses of the welding of specimens which were sliced and viewed by means of polarization microscopy.

FIG. 15 shows a possible form of the result of the welding process. It can be seen that a third zone has formed between the toothbrush body 12 and the carrier plate 20 as a result of the welding process. This weld zone 51 is illustrated in simplified form as its own zone, although in actual fact it is a connection between the two adjacent elements and preferably forms a continuous body together therewith. It can also be seen that the melted material does not spread into the gap 30 and that the outer surface 26 and the lateral surface 28 therefore do not contact and are not connected by material. This figure also shows that, for example, part of the carrier plate 20 may be melted and that the weld zone 51 may also spread into the region of the centering wall 58. This is only to be considered as one possibility, however, and the weld zone 51 preferably does not spread this far, and therefore no melting in the form of the weld zone 51 spreads between the centering wall 58 and the carrier plate 20. Naturally, FIG. 15 merely shows one practical instance. The image in this region of the toothbrush 10 can vary from toothbrush to toothbrush. Many factors play a role for the form and spread of the weld zone 51. These factors include the tolerances in the region of the injection molded parts, such as the carrier plate 20 and toothbrush body 12, and possible influences which involve the melting and fixing of the bristles on the carrier plate 20. Ultimately, the welding process plays a large role, for example the welding parameters and the tolerances in the structure of the welding assembly play a role in the process.

The illustration in FIG. 16 shows a situation which is to be avoided. The difference compared to FIG. 15 is that the weld zone 51, and with it the melted material, spreads or flows into the region of the gap 30 between the outer surface 26 and the lateral surface 28. It can also be seen that the melt and the welding process also melt areas close to the weld. When comparing FIGS. 15 and 16, this can be seen in that the walls of the gap, that is to say the outer surface 26 and the lateral surface 28, no longer extend in FIG. 16 in the manner in which they did when produced by injection molding. This also shows how the connection between the carrier plate 20 and toothbrush body 12 takes place in the region of the interface of the weld zone 51. The welding process is assisted by the melting of additional material.

It is also possible to attach the bristles to the carrier plate 20 by the IMT (in mold tufting) method and to then assemble said carrier plate in the mount 16 of the head part 14 and to weld it thereto, in particular by means of ultrasonic welding. It is also possible to produce toothbrushes 10 completely by the IMT method and to improve the fracture properties thereof by stretching them whilst they are still hot from the injection molding process. In this case, the hot state is generally caused by injection molding and not by a welding process.

A further tufting method, which can be applied in conjunction with the present invention, is the IAP (integrated anchorless production) method. In this case, too, the brush is stretched whilst still hot.

The variant shown, in which the receiving element 64 is arranged together with the further required devices about a round table 64', is to be considered as an example. It is also possible to arrange the receiving element 64 in a peripheral chain, an endless conveyor or another suitably adapted transport means and to thus implement the invention in the production method.

It is also possible to attach part of the bristle field 24 to the head part 14 itself, and to attach the other part to the bristle carrier element 18. This may also apply in the case of rubbery-elastic cleaning elements.

The production method according to the invention is not only suitable for manual toothbrushes, but also for the production of sonic toothbrushes and electric toothbrushes having rotating and/or pivoting head parts 14.

Furthermore, other types of cosmetic, body care or oral hygiene products, for example tongue cleaners or interdental cleaners, can also be produced by the method according to the invention.

Reference sign 22' in FIG. 1 denotes rubbery-elastic cleaning and massaging elements, which can be provided here instead of bristles 22 or together with bristles 22 on the carrier plate 20. Further additional elements may also be integrated into the carrier plate 20, such as movable or fixed elements having latched or snap-in connections.

The method according to the invention is suitable in particular if the toothbrush body 12 has been heated by means of an ultrasonic effect in the region of the head part 14 and/or the neck part 32.

So as to prevent connection of the outer surface 26 and the lateral surface 28, alternative variants are also possible besides the discussed variant of the gap 30. For example, adhesion reducers or adhesion suppressors may thus be printed, painted or sprayed onto the outer surface 26 and/or the lateral surface 28. Furthermore, the carrier plate 20 could be provided laterally with a soft component, which, similarly to the manner in which a seal acts, cannot be welded (due to the material properties), fills the gap 30 and thus prevents lateral welding.

Furthermore, the counter-surface 48 on the carrier plate 20 and/or the step 48 can be geometrically adapted to prevent lateral connection of the outer surface 26 and the lateral surface 28. Due to the provision of a reservoir/bunker/buffer in this surface, this element may collect some of the melt produced during ultrasonic welding so that the melt does not infiltrate the gap 30 and thus have a detrimental effect on fracture behavior.

It should also be mentioned that other arrangements of the weld bead 50 are also possible in order to provide the interface between the carrier plate 20 and the toothbrush body 12, which inter alia involves the mount 16. For example, the weld bead 50 may also be arranged at the free end of the centering wall 58. The accordingly adapted elements (base 46 and groove-like depression 54) contribute to the fact that the carrier plate 20 and the toothbrush body 12 are welded in the region of the base. Furthermore, the position of the weld bead 50 may also be varied with respect to the distance from the base 46 and to the front face 36 of the toothbrush body 12. As already described previously, the position is more likely deeper than illustrated. Other possibilities not discussed for the arrangement and geometric adaptation of the elements are not ruled out by the invention.

The ultrasonic welding process is defined by means of different parameters. The weld path, that is to say the path covered by the sonotrode 76 during the welding process, is thus between 0.05 mm and 0.4 mm, preferably 0.15 mm to 0.2 mm. The sonotrode 76 is excited by ultrasound with a frequency of 25,000 Hz to 45,000 Hz, preferably of 35,000 Hz to 40,000 Hz, at an amplitude of 0.02 mm to 0.12 mm, preferably 0.05 mm to 0.09 mm. An energy of 5 Ws to 35 Ws is thus expended, preferably 15 Ws to 25 Ws. With this parameter constellation and the previously described geometry, the welding process lasts from 0.03 seconds to 0.8 seconds, preferably from 0.05 seconds to 0.2 seconds, in particular 0.08 seconds.

Of course, the variants shown in this document are exemplary and the individual characteristics and elements of these variants can be combined with other variants without departing from the scope of this invention.

For the sake of completeness, it should be mentioned that it is possible to determine from the toothbrush 10 itself, for example by means of polarization microscopy, whether or not the toothbrush body 12 has been stretched. This is the case in particular with the use of transparent or opaque material for the toothbrush body 12.

The descriptions given for specific figures can of course also be transferred to other figures showing like or similar characteristics and in which the characteristics have not been described to the same level of detail.

The invention claimed is:

1. A method for producing a toothbrush, in which a toothbrush body having at least one head part and a neck part connected to the head part and carrying it is produced, the head part is provided with a carrier plate carrying bristles and the carrier plate is fixed to the head part by means of welding, and a force is then exerted on the toothbrush body, wherein the neck part and the head part are bent relative to one another from the original shape by a predetermined angle ($\alpha$), still in the hot state of the weld zone, by means of the force, and the force is removed after the bending process so as to allow the toothbrush body to bend back into its original shape.

2. The method as claimed in claim 1, wherein the toothbrush body is bent reversibly in a resilient region.

3. The method as claimed in claim 1, wherein the angle ($\alpha$) is 5° to 45°.

4. The method as claimed in claim 1, wherein the bending process is maintained for a predetermined period of time and the force is then removed.

5. The method as claimed in claim 4, wherein the period of time is 0.3 s to 5 s.

6. The method as claimed in claim 1, wherein the cycle time for the tufting of the carrier plate is greater than the time required for the welding and bending.

7. The method as claimed in claim 1, wherein a mount for the carrier plate is formed integrally on the head part when producing the toothbrush body, after which the carrier plate provided with said bristles is inserted into the mount, the carrier plate is fixed to the head part, and the neck part is then bent relative to the head part by means of the force.

8. The method as claimed in claim 7, wherein bending occurs at the weld zone heated by the ultrasonic welding process and at a zone close to the weld.

9. The method as claimed in claim 7, wherein, when the mount is produced, an outer surface is shaped in such a way that, when inserting the carrier plate, a gap between said outer surface and a lateral surface of the carrier plate remains free so as to prevent welding at this point.

10. The method as claimed in claim 7, wherein the tolerances of the head part with the mount and of the carrier plate are set in such a way that, with a maximum size of the carrier plate and a minimum size of the mount, a gap having a width of 0.03 mm to 0.35 mm is maintained between an outer surface of the mount and a lateral surface of the carrier plate, in such a way that no material from the weld zone infiltrates the gap, and the tolerances of a centering wall protruding from the carrier plate and of a second outer surface of the mount cooperating therewith and of a step extending between the outer surface and the second outer surface and of a counter-surface on the carrier plate cooperating therewith are set accordingly.

11. The method as claimed in claim 7, wherein, when producing the mount, an outer surface is formed, and an adhesion reducer is arranged between the outer surface and a lateral surface of the carrier plate so as to reduce or prevent welding at this point.

12. The method as claimed in claim 1, wherein the head part is held in a receiving element and is impacted by the force, at an end region of the neck part remote from the head part.

13. The method as claimed in claim 1, wherein the neck part is held in an end region remote from the head part by means of a receiving element and is impacted by the force at the head part.

14. The method as claimed in claim 1, wherein the toothbrush body is held by means of a receiving element in a grip part connecting to the neck part on the side remote from the head part and is impacted by the force at the head.

* * * * *